United States Patent [19]

El Moussa

[11] 4,069,978

[45] Jan. 24, 1978

[54] FUEL INJECTION VALVE

[75] Inventor: Wadid El Moussa, Cologne, Germany

[73] Assignee: Klockner-Humboldt-Deutz Aktiengesellschaft, Cologne, Germany

[21] Appl. No.: 751,695

[22] Filed: Dec. 17, 1976

[30] Foreign Application Priority Data

Dec. 20, 1975 Germany ..... 2557772

[51] Int. Cl.[2] ..... B05B 1/30; B21D 53/00

[52] U.S. Cl. ..... 239/533.2; 29/157 C; 29/558; 219/69 M; 219/121 EM

[58] Field of Search ..... 239/533.2–533.12; 29/157 C, 557, 558; 219/69 M, 121 EM

[56] References Cited

U.S. PATENT DOCUMENTS

| | | | |
|---|---|---|---|
| 3,425,635 | 2/1969 | Guertler | 239/533.3 |
| 3,430,866 | 3/1969 | Guertler | 239/533.3 |

FOREIGN PATENT DOCUMENTS

| | | | |
|---|---|---|---|
| 50,655 | 6/1933 | Denmark | 239/533.3 |
| 227,224 | 5/1942 | Switzerland | 239/533.3 |

*Primary Examiner*—Robert W. Saifer
*Attorney, Agent, or Firm*—Walter Becker

[57] ABSTRACT

A fuel injection valve having nozzle bores which are inclined with respect to the axis of the valve. The nozzle bores are similar to Laval nozzles. An auxiliary bore is provided in the axial extension of the nozzle bore to be prepared in the nozzle body for machining the nozzle bore. This bore is sealed by means of a pressed in, soldered, or electron beam welded stopper.

5 Claims, 2 Drawing Figures

FUEL INJECTION VALVE

The present invention relates to a fuel injection valve having nozzle bores which are inclined with respect to the axis of the valve, said nozzle bores being shaped similar to Laval nozzles.

Such a fuel injection valve has been disclosed in German Pat. No. 12 12 352. With this known nozzle bore, however, only the injection opening is of the Laval nozzle type, whereby a flow assisting intake is achieved. A widening of the nozzle bore from the narrowest cross section is not provided.

German Pat. No. 631 135, shows several forms of nozzle bores. Among others, a Laval nozzle-like bore is described. The nozzle bores are arranged in a valve cap and are coaxial to the axis of the valve. The valve cap is divided in the longitudinal direction of the nozzle bore so that the nozzle bore can be machined out of the material from the thus formed plane of division.

After the parts of the nozzle cap have been machined, the said parts are put together in such a way that the recesses fit precisely in the position corresponding to the contemplated channel form. Difficulties arise during assembly of the parts of the nozzle cap with regard to the alignment and location fixing of the individual parts.

Futhermore, it is known from Swiss Pat. No. 479 806 with composite fluid nozzles to finish the nozzle cap as an individual element and to connect the nozzle head to the nozzle body by means of electron beam welding. In this connection, difficulties have also been encountered with regard to alignment and the texture change in the area of the welding seam. Errors in alignment are detrimental to the fuel injection and the combustion while changes in the texture impair the strength, so that damages have to be reckoned with at today's normally high injection pressures.

It is an object of the present invention to produce a fuel injection valve in a nozzle cap which is formed on the nozzle body so as to form one piece therewith, while the nozzle bores may be machined into the nozzle cap in the shape of Laval nozzles without impairing the strength of the nozzle cap.

These and other objects and advantages of the present invention will appear more clearly from the following specification in connection with the accompanying drawing, in which.

Figure 1:
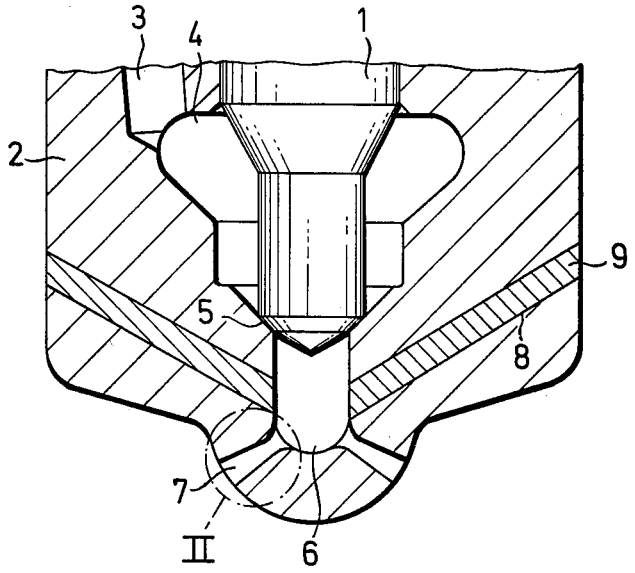
FIG. 1 is a partial longitudinal section of a fuel injection valve according to the present invention.
Figure 2:
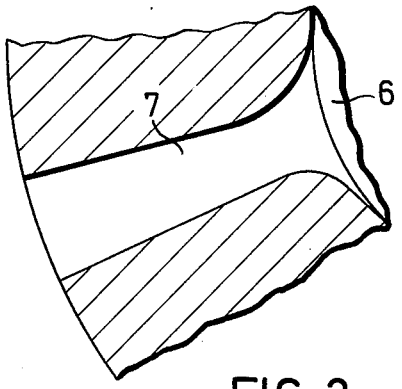
FIG. 2 shows on a larger scale than FIG. 1 that part of FIG. 1 which is encircled by the dot-dash circle II of FIG. 1.

The fuel injection valve of the present invention is characterized primarily in that an auxiliary bore is provided in the axial extension of the nozzle bore to be prepared in the nozzle body for machining the nozzle bore. This last mentioned bore is closed in accordance with strength requirements by means of a pressed-in, soldered, or electron beam welded stopper. By means of said auxiliary bore in the nozzle body, the tool can, for example, for the spark machining of the nozzle bore, be precisely aligned and be guided to correspond to the desired shape of the nozzle bore. The bores are closed off with a stopper after the machining of the nozzle bore without the strength of the nozzle cap being reduced.

Referring now to the drawing in detail, the fuel injection valve comprises a valve needle 1 which is guided in a nozzle body 2 and opens in a direction counter to the direction of flow of the fuel. An inlet bore 3 and a pressure chamber 4 are machined into the body of the nozzle body 2 and are closed off at the needle seat 5 by means of the valve needle 1. Behind the needle seat 5 when viewed in the direction of flow, is a blind bore 6 from which the nozzle bores 7 start. Nozzle bores 7 are formed like Laval nozzles. In axial alignment with the nozzle bores 7 to be prepared, for machining the same there are provided auxiliary bores 8, through which a nozzle bore machining tool can be aligned and guided. After the machining of the nozzle bores 7, the bores 8 are sealed by stoppers 9, which are either pressed in, soldered, or electron beam welded.

It is, of course, to be understood that the present invention is, by no means, limited to the specific showing in the drawing, but also comprises any modifications within the scope of the appended claims.

What I claim is:

1. A fuel injection valve, which includes: a valve body having a needle bore and also being with at least one nozzle bore, a valve needle reciprocably mounted in said needle bore for controlling the admission of fuel to said at least one nozzle bore, the elongation of the longitudinal axis of said nozzle bore intersecting the elongation of the longitudinal axis of said needle bore while being inclined thereto, said valve body also being provided with auxiliary passage means substantially in axial alignment with said at least one nozzle bore for facilitating the machining of the latter, and stopper means sealing said auxiliary passage means.

2. A valve according to claim 1, in which said stopper is sealingly pressed into said auxiliary passage means.

3. A valve according to claim 1, in which said stopper is sealingly electro-beam welded into said auxiliary passage means.

4. A valve according to claim 1, in which said stopper is sealingly soldered into said auxiliary passage means.

5. A valve according to claim 1, in which said at least one nozzle bore has the shape of a Laval nozzle.

* * * * *